US005215238A

United States Patent [19]

Baruch

[11] Patent Number: 5,215,238

[45] **Date of Patent: * Jun. 1, 1993**

[54] HOLSTER FOR A WEAPON WITH LASER LIGHT

[76] Inventor: Alan Baruch, 3119 Shannon Dr., Puntagorda, Fla. 33982

[ * ] Notice: The portion of the term of this patent subsequent to Mar. 10, 2009 has been disclaimed.

[21] Appl. No.: 776,050

[22] Filed: Oct. 11, 1991

Related U.S. Application Data

[63] Continuation-in-part of Ser. No. 697,322, May 8, 1991, Pat. No. 5,094,376.

[51] Int. Cl.[5] ..... F41C 33/02

[52] U.S. Cl. ..... 224/243; 224/244; 224/253; 224/911

[58] Field of Search ..... 224/243, 244, 911, 253, 224/242, 246, 245, 193

[56] References Cited

U.S. PATENT DOCUMENTS

| | | | |
|---|---|---|---|
| 2,951,622 | 9/1960 | Heim | 224/911 |
| 3,645,428 | 2/1972 | Angell | 224/244 |
| 3,804,306 | 4/1974 | Azurin | 224/911 |
| 4,815,641 | 3/1989 | Bianchi et al. | 224/243 |

*Primary Examiner*—Linda J. Sholl
*Attorney, Agent, or Firm*—Blum Kaplan

[57] ABSTRACT

A holster formed of a fabric material suitable for weapon with a laser light having internal retention. The holster is formed from a piece of synthetic material which is folded on itself and secured to a barrel stop at the bottom to form a cavity for receiving the weapon. An elastic strap along the back opposite the fold line secures the weapon in the holster and urges the weapon towards retention elements secured to the inside of the fabric at the ejection port and trigger of the weapon.

9 Claims, 3 Drawing Sheets

HOLSTER FOR A WEAPON WITH LASER LIGHT

CROSS-REFERENCE TO RELATED APPLICATION

This application is a continuation-in-part of application Ser. No. 07/697,322, filed on May 8, 1991 now U.S. Pat. No. 5,094,376 issued Mar. 10, 1992.

BACKGROUND OF THE INVENTION

This invention relates to a holster for a semi-automatic weapon with a laser light and in particular, to a holster which retains the semi-automatic weapon (hereinafter referred to as a "weapon") securely and can be made of lightweight, durable and inexpensive materials.

Weapon holsters, which are well known in the art, are generally attached to a belt that is worn around the waist, leg, chest or elsewhere on the body. Typically, such holsters are in the shape of the weapon with an opening at the top for inserting and removing the weapon. Some holsters employ a restraining system wherein a releasable strap extends above the grip of the holstered weapon across the opening to secure the weapon in place.

The disadvantage of this single strap system is that the user's opponent has relatively easy access to the weapon merely by releasing the strap with one hand and removing the weapon by its grip with the other. Additionally, if the user is engaged in such physical activity as rolling or crawling, the strap may become undone and the weapon may accidentally slip out of the holster. The magnitude of the problem is exemplified in that 80% of police gunshot injuries and fatalities in the United States currently are inflicted to the officer by his or her own weapon.

Known weapon holsters designed to restrain the weapon more securely are made of leather with a releasable strap above the grip and another releasable strap across the trigger guard on the rearward side of the holster. This type of holster has an elaborate design, including a steel shank covered with leather which sits directly on top of the ejection port of an automatic weapon. To maintain the steel shank in its exact position, a steel member goes around the weapon to give the holster tension, and a steel screw is attached at the lower portion of the steel shank to apply pressure to the leather. To remove the weapon, both straps must be undone and the weapon must be removed in a backward, lifting motion. If only the upper strap is undone and the weapon is pulled straight up, the ejection port will be caught by the steel shank and the weapon cannot readily be removed from the holster.

The disadvantages of this holster are several. First, the holster is made of leather, which is subject to damage by water. It is also more expensive, heavier, and less durable than many man-made materials. Moreover, the elaborate steel shank design is complicated and expensive, and the leather in the region around the steel shank is subject to wear and not replaceable after it has worn away.

Lightweight and durable nylon holsters are also known in the art. Since nylon is lightweight and flexible, nylon holsters are unable to accommodate the complicated steel shank design utilized in the double-strap type leather holster. In order to provide the desirable feature of known stiff holsters, a nylon holster has been developed including a pocket on the inside of the holster which contains a plastic dowel. The plastic dowel secures the weapon by engaging the weapon above the muzzle end of the ejection port of the weapon. Although this structure is satisfactory, a holster structure which further helps to prevent accidental or unintentional removal of the weapon from the holster is desirable.

The nylon holster known in the art which is a plastic dowel generally are formed with a portion of the holster back stitched and a back keeper strap or elastic band urge the weapon forward so that the ejection port is engaged by the dowel stretched. Snaps are disengaged or the elastic band is stretched to remove the weapon from the holster. These holsters are not suitable for use with weapons equipped with a laser light which is generally positioned below the barrel and extends beyond the nozzle.

Accordingly, it is desirable to provide a holster for a weapon equipped with a laser light which avoids these difficulties yet can be fabricated of a lightweight, inexpensive, waterproof and durable material and which also prevents the weapon from being removed by accident or by an opponent. It is also desirable to provide such a weapon holster which can be worn against the leg and which may allow rapid removal by the user.

SUMMARY OF THE INVENTION

Generally speaking, in accordance with the invention, a holster for a weapon with a laser light having internal restraining elements is provided. The holster is made of a fabric material which is folded over itself to form a cavity with a top opening and includes a barrel stop at the bottom to define the opening and stop downward movement of the weapon. The interior of the fabric includes at least one restraining dowel at the ejection port to prevent inadvertent upward removal of the weapon. An elastic strap extends substantially across the rear opening of the holster and urges the weapon towards the dowel to secure the weapon in the holster.

The holster is suitable to be worn against a leg. The elastic strap secures the weapon in the holster and urges the weapon towards the dowel, yet allows the user to remove the weapon rapidly without having to release a back snap.

Accordingly, it is an object of the invention to provide an improved holster for a weapon with a laser light.

Another object of the invention is to provide a holster for a weapon with a laser light which prevents easy removal of the weapon by someone other than the user.

A further object of the invention is to provide a holster for a weapon with a laser light which prevents accidental release of the weapon during strenuous physical activity by the user.

Still another object of the invention is to provide a holster for a weapon with a laser light made of a lightweight synthetic material.

An additional object of the invention is to provide a holster for a weapon with a laser light which may be worn against the leg and which will allow for rapid removal by the user.

Still a further object of the invention is to provide a holster for a weapon with a laser light made of an inexpensive material.

Yet another object of the invention is to provide a holster for a weapon with a laser light which is durable and waterproof.

Still other objects and advantages of the invention will in part be obvious and will in part be apparent from the specification.

The invention accordingly includes an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
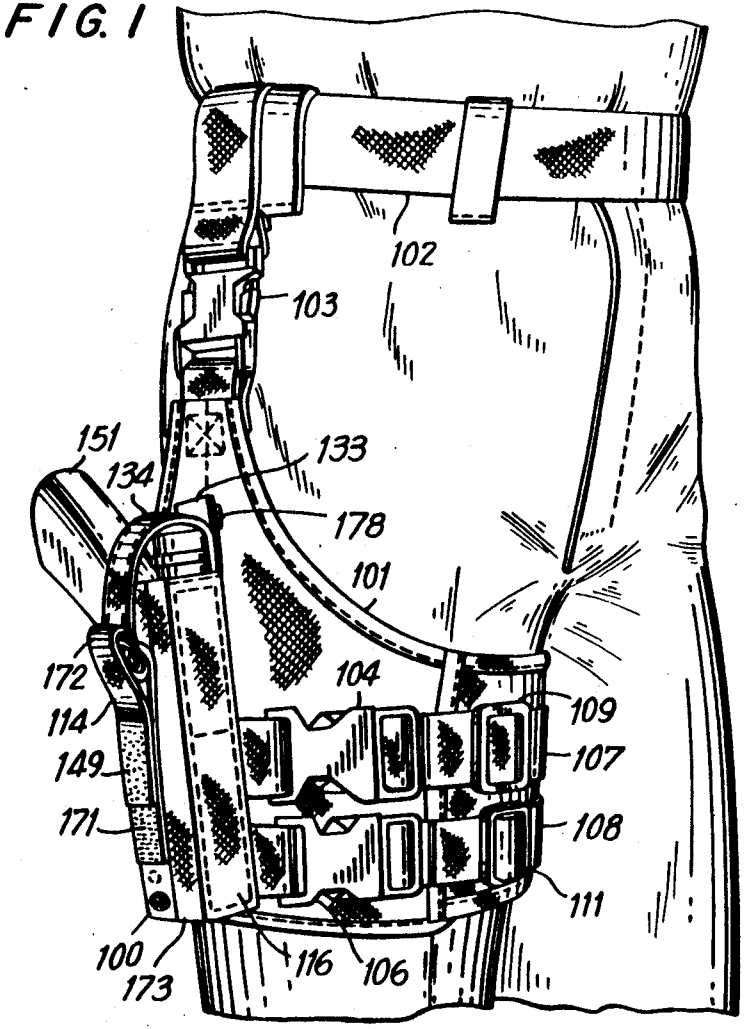
FIG. 1 is a front-angle illustration of a holster constructed and arranged in accordance with a preferred embodiment of the invention as worn against the leg by a user with a weapon secured in place.
Figure 3:
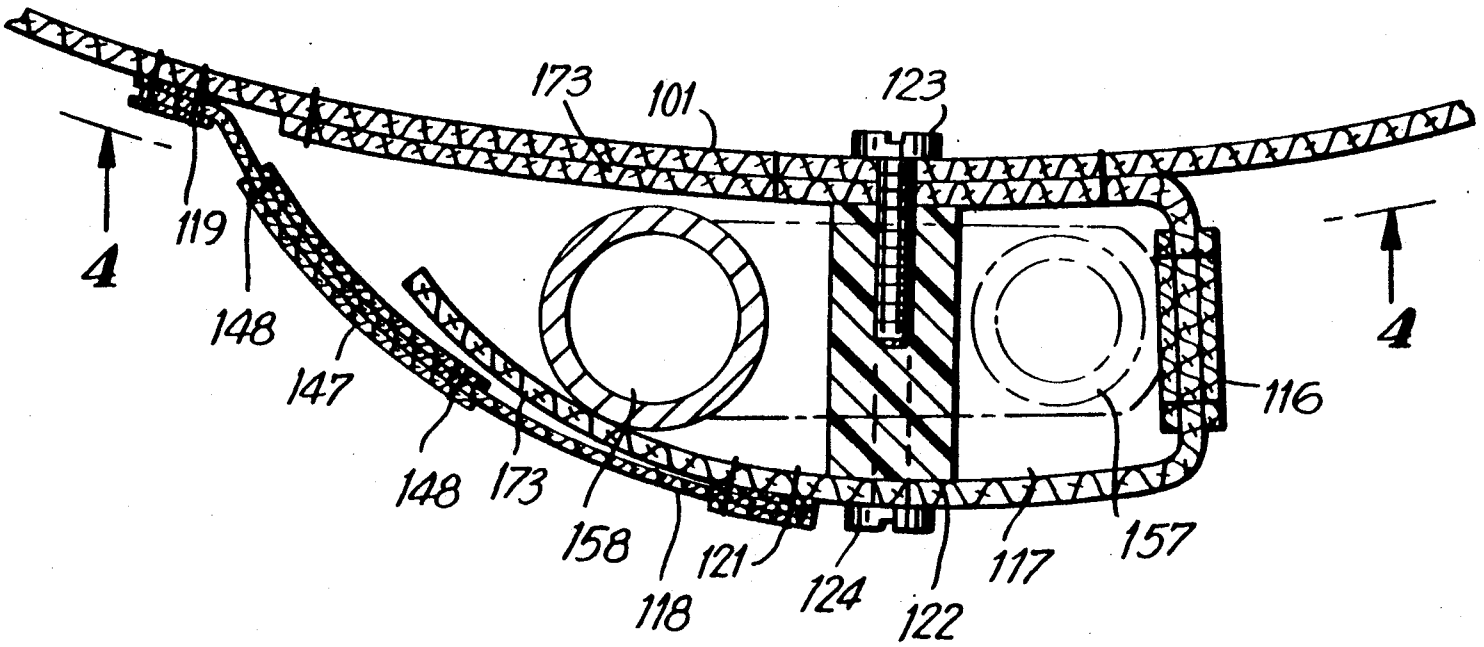
FIG. 3 is a cross-sectional view taken along line 3—3 of FIG. 2 and illustrates, in detail, the barrel stop positioned in the bottom of the holster of FIG. 1.

A holster 100 constructed and arranged for securing an automatic weapon 151 with a laser light and adapted to be worn against a leg is illustrated in FIG. 1. Holster 100 is fabricated from synthetic materials, such as a holster fabric piece 173 of multilayer ballistic nylon with polypropylene and nylon reinforcing elements so that it is lightweight, formfitting, weather resistant, washable and maintenance free. Because safety of the wearer is important, particularly in police environments, holster 100 is designed to reduce or prevent automatic weapon 151 from being removed from holster 100 by a second person or accidentally during strenuous activity.

Figure 2:
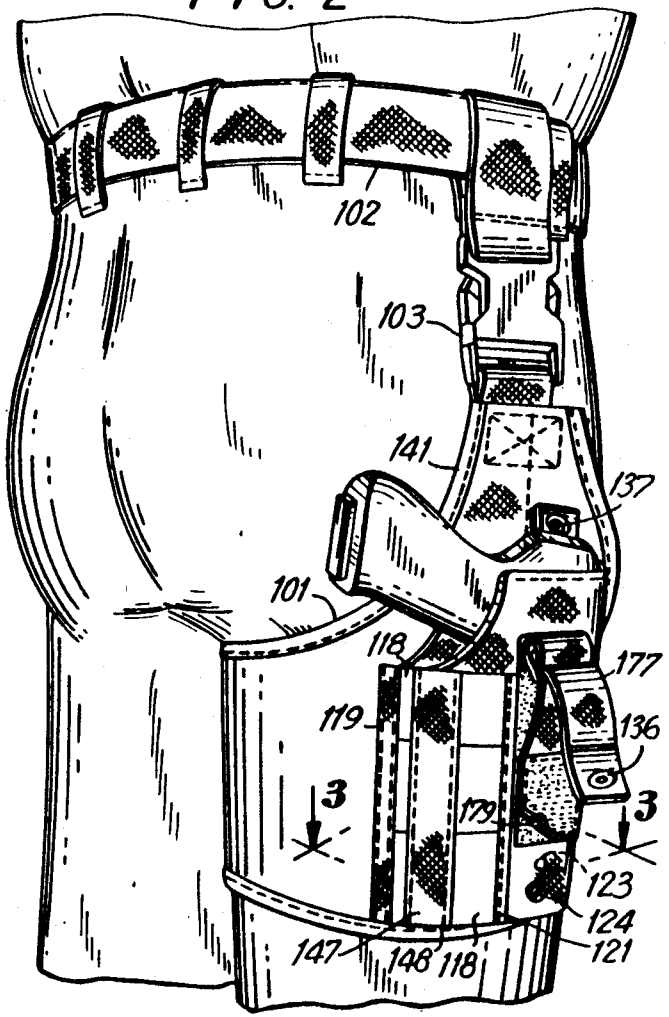
FIG. 2 is a back-angle of the same illustration as FIG. 1.

Holster 100 is stitched to a leg sash 101 which in turn is releasably secured to belt 102 with a first buckle 103. Leg sash 101 is also wrapped around and releasably secured to a leg with second and third buckles 104 and 106 with adjustments to the width of the individual leg effected by the use of adjusting straps 107 and 108 and adjusting slides 109 and 111. Leg sash 101 may be made of a lightweight fabric, and buckles 103–106 and slides 109 and 111 may be made of a lightweight plastic. Leg sashes such as leg sash 101 illustrated in FIGS. 1 and 2 are known in the art, and so the invention is not limited to the particular sash illustrated herein.

Weapon 151 is formed with a laser light 158 and a barrel 157 mounted on a grip 162 with a trigger 152 protected by a trigger guard 153. Trigger guard 153 has a front portion 154 which is opposed to trigger 152. A hammer 156 is at the rear of barrel 157. An elongated ejection port 159 is located along the upper right side of barrel 157 and is formed with a front shoulder 161. Most automatic pistols presently on the market, including weapons with laser lights, are formed with similar ejection ports as shown in weapon 151.

Retention of weapon 151 in holster 100 is accomplished by an elastic strap 118 which is secured directly on holster 100 with stitching 121 and on leg sash 101 with stitching 119. Elastic strap 118 is made of an elastic material which has sufficient strength to force the ejection port of weapon 151 against the ejection port dowel 126 to prevent inadvertent removal of weapon 151, yet may be stretched with pressure from weapon 151 by the user to allow weapon 151 to be withdrawn from holster 100. In the embodiment illustrated, elastic made of elastic strap 118 is made of three elastic pieces, each about two inches high, to give a total height of approximately 6 inches to elastic strap 118. This length may, however, vary depending on the particular make and model of weapon used.

In addition to the elastic strap 118 securing mechanism, a substantially rigid barrel stop 122 is secured to the interior of the bottom opening 174 of fold end fabric piece which maintains the configuration of holster cavity 117 and prevents the weapon 151 from slipping through the bottom opening 174. A primary hammer keeper strap 134 is additionally provided across hammer 156 and is releasably secured to a primary thumb break 133. Primary keeper strap 134 includes a male snap member 136 which cooperates with a female snap portion 137 mounted on primary thumb break 133.

Retention of weapon 151 in holster 100 is also partially accomplished by securing a plastic dowel 126 on the interior surface of holster 100 above the muzzle end of ejection port 159 on the injector side of weapon 151. A trigger guard plastic dowel 127 on the interior surface of holster 100 between trigger 152 and trigger guard 153 further seems weapon 151 in holster 100. The combination of barrel stop 122, elastic strap 118, dowel 126 and trigger guard dowel 127 ensures maximum retention of weapon 151 in holster 100.

Holster body 100 is formed from fabric piece 173 which is folded on itself to form a holster cavity 117 particularly well suited to accommodate and restrain an automatic weapon 151 with a laser light. Similarly, dowels 126 and 127 are positioned to engage ejection port 159 and trigger guard 153 on weapon 151 when positioned within holster cavity 117. In the following description, dimensions are recited for a particular weapon, it being understood that the concepts applied herein are applicable to a wide variety of weapon sizes and shapes.

Holster body 100 in the embodiment illustrated in FIG. 1 is formed from a substantially square multi-layer piece of ballistic nylon having a dimension approximately 7" wide and 6½" high, commonly referred to as 1050 denure ballistic nylon available from a number of different manufacturers including, but not limited to, E. I. DuPont de Nemours & Co. Holster 100 is multi-layered and has an interior fabric piece and a mating outer fabric piece. The interior and exterior fabric pieces are a single ply with mating upper cut out sections 141. Either one or both pieces of the fabric may be single or multi-layered.

During fabrication, interior fabric and outer fabric are laid up together, stitched along the perimeter and turned inside out with a stitch line to enclose the edge fully. The fabric pieces are then quilt stitched at approximately 1" spaces along quilt stitching lines. Elastic strap 118 is secured into position running vertically along outer fabric with stitching 121, on leg sash 101 with stitching 119 and with elastic strap fabric 147 and stitching 148. Similarly, primary thumb break 133 and primary keeper strap 134 are positioned vertically above elastic strap 118 and secured to the composite fabric of holster body 100 by stitching. In all cases fabric and tapes are cut by a hot blade to prevent any unravelling of the woven yarns.

At this point, composite fabric 173 of holster body 100 possesses structural integrity from the multi-layer thickness and the additional stitched straps. In order that the completed holster maintain its shape, a stiffening tape 116 is laid down running vertically substantially through the mid-point of composite fabric piece 173 with at least a single layer thickness running across inner fabric and outer fabric along what will be a fold line between two halves of holster 100. In a preferred embodiment two thicknesses of stiffener tape 116 are secured on inner surface of holster fabric 173 and one is on outer surface.

Figure 4:
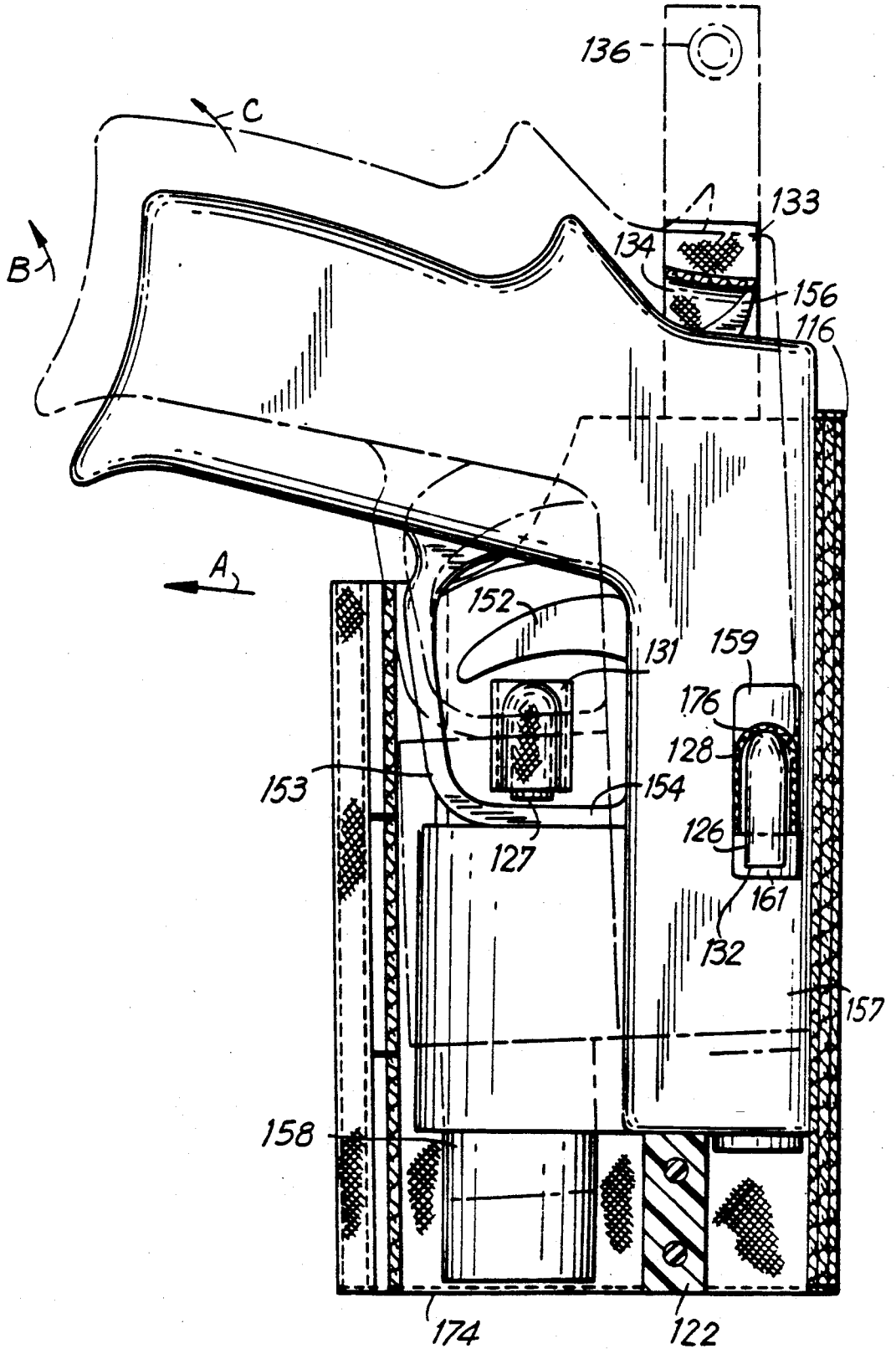
FIG. 4 is a cross-sectional view taken along line 4—4 of FIG. 3 and illustrates, in detail, the motion required to remove the weapon from the holster of FIG. 1.

A dowel pocket 128 is positioned to one side of stiffener tape 116 on inside fabric of composite fabric 173. As noted above, the specific location of dowel pocket 128 will depend on the particular model of weapon 151 for which holster body 100 is being fabricated. Dowel pocket 128 is positioned to the right side of stiffener tape 116 somewhat above the mid-point of the height of holster fabric 173 as shown in FIG. 4. Dowel pocket 128 is stitched with stitches running both vertical sides and horizontally across the top of dowel pocket 128 with a downwardly facing opening.

A trigger guard dowel pocket 131 is positioned adjacent to an edge on inside fabric of composite fabric 173 and stitched with stitching. The exact location of trigger guard dowel pocket 131 will depend on the particular model of weapon 151 for which holster body 100 is being fabricated. Trigger guard dowel pocket 131 may be positioned adjacent either edge of inside fabric. However, for reasons detailed below, the preferred edge is the one which is worn closest to the user's body such that trigger guard dowel pocket 131 is on the portion of inside fabric adjacent the user's body.

During assembly of holster body 100, outside ends are folded over and secured by elastic strap 118 and stitching 121 and 119 running vertically and substantially parallel to weapon barrel 157. Holster fabric 173 is folded about both edges of stiffener tape 116 which then forms the front of holster 100. A barrel stop 122 is positioned at the bottom, inside portion of the fabric piece to further stiffen the configuration of the holster body 100 and to prevent the weapon 151 from slipping through the bottom opening 174 of holster body 100. The plastic insert 122 is secured to the fabric piece by opposing screws 123 and 124. Screw 124 extends from the outer fabric piece into the barrel stop 122. Screw 12 extends from the leg sash 101 through the outer fabric of holster 100 and into barrel stop 122. After completion of stitching 121 and 119 and securing the barrel stop 122, holster body 100 is sufficiently stiff to maintain its configuration to receive weapon 151.

Referring specifically to FIG. 4, weapon 151 is shown engaged within holster body 100. Weapon 151 is typical of automatic weapons with laster lights presently available having ejection port 159 adjacent to the upper right side portion thereof. Ejection port 159 is an elongated depression in the side of weapon 151 and includes a front shoulder 161. As noted above, when weapon 151 is engaged in holster body 100, dowel 126 formed with a flat lower end 132 is seated immediately above and overlapping front shoulder 161 of ejection port 159. Dowel 126 is approximately ¼" in diameter by about ⅝" to ¾" in length and can be formed of a rigid plastic, wood or metal. Dowel 126 is formed with a tapered upper end 176 to facilitate snug insertion into dowel pocket 128 during assembly. The exact size of dowel 126 depends on the particular weapon for which holster body 100 has been fabricated.

In all constructions, the distance between front shoulder 161 and flat end 132 of dowel 126 is important. If the distance is too great, dowel 126 will fail to engage front shoulder 161. If the distance is too small, it will be more difficult to remove weapon 151 intentionally even when all the external securing devices are released. In the preferred embodiments when weapon 151 is secured in holster 100, the distance maintained between dowel 126 and shoulder 161 of ejection port 159 is between about ⅜" to ½". The specific distance therebetween will depend upon the particular weapon.

Trigger guard dowel 127 is similar to dowel 126 and interacts with front portion 154 of trigger guard 153 in much the same manner that dowel 126 interacts with front shoulder 161 of ejection port 159. Trigger guard dowel 127 and pocket 131 are sized and positioned to be between trigger 152 and trigger guard 153 such that trigger 152 does not contact trigger guard dowel 127 and pocket 131 even when weapon 151 is positioned as far as possible into holster 100. The distance between front portion 154 of trigger guard 153 and trigger guard dowel 127 must likewise be large enough to permit the removal of weapon 151 from holster 100 when twisted properly, but yet must be small enough so that trigger guard dowel 127 engages trigger guard 153.

The appropriate way to remove weapon 151 from holster 100 is shown in FIG. 4. The solid line showing of weapon 11 is in the secured position. When a thumb disengages thumb break snap elements 137 and 136, strap 134 falls away from holster 100 because of the weight of strap 134 due to the presence of stiffening tape 177 attached to the inner side of primary keeper strap 134. This allows sure and quick access to weapon 151. To facilitate this action, stiffening strip 177 must not extend beyond that portion of strap 134 directly above slide 172 or whatever direct or indirect method is used to attach strap 134 to holster fabric piece 173. This region of keeper strap 134 above slide 172 functions as a hinge which keeps strap 134 away from thumb break 133 when opened.

With the external securing devices released, weapon 151 is initially displaced in a natural rearward direction as shown in phantom by arrow A in FIG. 4. At the same time, weapon 151 is twisted slightly as shown in phantom by arrow B. Weapon 151 is then removed upwardly in the direction shown by an arrow C. The initial natural rearward direction separates shoulder 161 from a position where it can be engaged by flat end 132 of dowel 126. The twisting motion releases weapon 151 from a position where trigger guard 153 is engaged by trigger guard dowel 127. The twisting motion is in the direction away from trigger guard dowel 127. Since the twisting motion is easier to accomplish in a direction away from instead of towards the body, trigger guard dowel 127 is preferably located on the side of inside fabric 138 which is closest to the user's body.

Holster 100 may also have a second releasable upper safety strap 114. As shown in FIG. 1, safety strap 114 is attached to fabric 173 and extends through second slide 172. A first inner Velcro portion 149 is stitched to safety strap 114 with a cooperating Velcro loop tape 178 which is attached to thumb break 133 opposite the side where Velcro tape 149 is attached. Second inner Velcro hook tape 171 is stitched to fabric 173 directly under slide 172. When safety strap 114 is extended over primary keeper strap 134 and thumb break 133, Velcro tape 149 on strap 114 engages first Velcro loop tape 178 on thumb break 133, thereby further securing weapon 151 in holster 100. Safety strap 114 may be stored in an away position when second Velcro loop tape 179 on strap 114 is engaged by second Velcro hook tape 171.

Holster 100 is made of synthetic materials which have many advantages over leather. Specifically, leather is more expensive, heavier, and less durable. Unlike leather, synthetic materials are waterproof and will not be ruined by exposure to salt water. Thus, the weapon holster according to the invention will be particularly suited to use in outdoor conditions, particularly for SWAT teams and coastal patrols.

Holster composite fabric 173, dowel pockets 128 and 131 and the assorted straps may be made of any synthetic material which is waterproof. It is anticipated that polymers such as polyamides will be preferred as materials. Particularly, preferred polyamides include Ballistic Nylon and Kodura Pack Cloth.

Dowels 126 and 127 may be made of a variety of materials, for example, any rigid plastic, wood or steel. Nevertheless, plastic is particularly preferred because of its inexpensive and lightweight nature.

The operation of a holster constructed and engaged in accordance with the invention is as follows. The user first releases the safety strap, if present and engaged. He then simultaneously uses his thumb to disengage the hammer snap. This movement can be accomplished in the same fluid motion as the hand is closing around the handle of the weapon. The weapon is then removed in a backwards, twisting and lifting motion which becomes automatic with minimal practice by the user.

For an assailant to remove the weapon, however, he must first release the safety strap, if present and positioned. He must second disengage the hammer snap. The assailant must then remove the weapon in a backwards, twisting and lifting motion while simultaneously pushing against the elastic strap attached at the rear opening of the fabric piece. If the assailant releases only one strap or lifts the weapon straight up or without twisting, the gun will not be released from the holster due to the resistance provided by the elastic strap and the engagement of the ejection port and trigger guard by the dowels. This combination makes it extremely difficult if not impossible to remove the weapon from a non-user position.

Similarly, if the user is engaged in such physical activity as rolling or crawling, the likelihood of the straps becoming undone and the weapon moving in the exact backwards, twisting and lifting direction opposite the resistance afforded by the elastic strap is much smaller than in a single-strap weapon holster that does not have the pocket and dowel configuration, or even in a holster that has only a single pocket and dowel configuration.

For holsters intended to be worn against the leg, elastic strap 118 is preferable over the conventional snaps and straps system because the side of the user's index finger has more difficulty releasing the snaps if the holster is worn against the leg as opposed to the waist. Elastic strap 118 secures weapon 151 in holster 100 yet allows weapon 151 to be withdrawn quickly when needed, whether a single or multiple dowel system is utilized in holster 100.

It will thus be seen that the objects set forth above among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A holster for retaining a weapon with a laser light comprising:

a fabric piece of a synthetic material folded on itself to form a fold line in the front and the edges of the fabric piece aligned along the rear to form an interior cavity substantially corresponding to the shape of the weapon with a primary upper opening which extends to a partial rear opening for inserting the weapon into the cavity, and a bottom opening;

stiffening tape means disposed along the fold line of the fabric piece for defining the front of the holster;

a substantially rigid barrel stop secured to the folded fabric at the bottom opening to retain the folded fabric and prevent slippage of the weapon through the bottom opening; and elastic strap means extending substantially along the rear opening for securing the weapon in the holster cavity.

2. The holster of claim 1, further including a first engagement element secured to the inside of the fabric piece and adjacent to the fold line and positioned to engage the ejection port of the weapon in the cavity whereby when a weapon is inserted into the holster cavity, the elastic means urging the weapon against the first engagement element to prevent withdrawal of the weapon in a substantially upward direction.

3. The holster of claim 2, further including a second engagement element secured to the inside of the fabric piece adjacent to an edge and positioned to cooperate with the trigger guard on the weapon.

4. The holster of claim 2, wherein the first engagement element is a downwardly facing pocket secured to the inside of the fabric piece and a substantially rigid dowel having a substantially flat bottom disposed in the pocket.

5. The holster of claim 3, wherein the second engagement element is a downwardly facing pocket secured to the inside of the fabric piece and a substantially rigid dowel having a substantially flat bottom disposed in the pocket.

6. The holster of claim 1, also including a primary keeper strap extending over the hammer portion of the weapon.

7. The holster of claim 6, wherein the hinged primary keeper strap is mounted to the outside of the holster body extending away from the user's body when in an open position and extending over the hammer portion of the weapon when in a closed position, the keeper strap being weighted in the portion away from the mounting to the holster so that when in the open position the keeper strap remains away from the path of removal of the weapon from the holster.

8. A holster for retaining a weapon with a laser light and suitable to be worn against a leg, comprising:

a fabric piece of a synthetic material folded on itself to form a fold line in the front and the edges of the fabric piece aligned along the rear to form an interior cavity substantially corresponding to the shape of the weapon with a primary upper opening which extends to a partial rear opening for inserting the weapon into the cavity, and a bottom opening;

leg sash means for selectively mounting about a wearer's legs, one face of the folded fabric piece mounted to the sash means;

stiffening tape means disposed along the fold line of the fabric piece for defining the front of the holster;

a substantially rigid barrel stop secured to the folded fabric at the bottom opening to retain the folded fabric and prevent slippage of the weapon through the bottom opening;

elastic strap means extending substantially along the rear opening secured to the outer face of the folded fabric piece and the leg sash for closing the rear opening and securing the weapon in the holster cavity;

a first engagement element secured to the inside of the fabric piece and adjacent to the fold line and positioned to engage the ejection port of the weapon in the cavity whereby when a weapon is inserted into the holster cavity, the elastic means urges the weapon against the first engagement element to prevent withdrawal of the weapon in a substantially upward direction; and a primary keeper strap extending over the hammer portion of the weapon.

9. The holster of claim 8, further including a second engagement element secured to the inside of the fabric piece adjacent to an edge and positioned to cooperate with the trigger guard on the weapon.

* * * * *